United States Patent [19]

Grable

[11] 4,262,273

[45] Apr. 14, 1981

[54] THERMOSTATIC ELECTRICAL SWITCH

[75] Inventor: Jack W. Grable, Dayton, Ohio

[73] Assignee: Emerson Electric Co., St. Louis, Mo.

[21] Appl. No.: 99,133

[22] Filed: Nov. 29, 1979

[51] Int. Cl.[3] ..... H01H 71/16

[52] U.S. Cl. ..... 337/67; 337/94

[58] Field of Search ..... 337/67, 94, 349, 360

[56] References Cited

U.S. PATENT DOCUMENTS

| | | | |
|---|---|---|---|
| 3,230,607 | 1/1966 | Gelzer | 337/94 X |
| 4,047,141 | 9/1977 | Holden | 337/94 X |
| 4,201,967 | 5/1980 | Romerdahl et al. | 337/94 X |

*Primary Examiner*—George Harris

*Attorney, Agent, or Firm*—Biebel, French & Nauman

[57] ABSTRACT

An electrical thermostatic switch, prior to calibration, has a flexible blade which is spring biased into contact with a thermostatic member. The end of the blade is submerged in a heat curable material. The switch is placed in an oven at a predetermined temperature level for calibration, with the result that the thermostatic element moves the flexible blade into the desired calibration position prior to curing of the heat curable material. The flexible element is thereafter held by the cured material in the desired calibration position.

14 Claims, 7 Drawing Figures

THERMOSTATIC ELECTRICAL SWITCH

BACKGROUND OF THE INVENTION

The present invention relates to temperature sensitive electrical switching devices and, more particularly, to an improved switching device construction which provides for simple, accurate calibration.

It is desirable to protect electrical devices, such as motors, generators, and transformers, from the effects of overheating. While power supply lines circuit breakers provide protection from excessive currents for such electrical devices, circuit breakers do not protect against overheating which may occur during continuous operation of a device at a current level which is not excessive. To provide adequate thermal protection for an electrical device, a thermally responsive switch may be placed within the device to monitor the temperature of the device. Such a switching device may be of the type which completes an electrical circuit when the temperature of the device exceeds a predetermined threshold temperature; alternatively, it may be of the type in which an electrical circuit is broken when the temperature of the device exceeds the predetermined threshold temperature.

In order for a thermostatic switch to be positionable within many electrical devices, however, it is necessary that the thermostatic switch be relatively small in size. In fabricating such a miniaturized thermostatic switch, accurate positioning of the switch elements to afford precise calibration of the switching device has been difficult to achieve.

Many prior art switches include a thermostatic blade having a first electrical contact and a second, stationary electrical contact. Some switching devices have been calibrated by manually adjusting the position of the second electrical contact, either by means of an adjusting screw or, alternatively, by denting the switch casing so as to move the second electrical contact into its desired position. Neither of these techniques has been particularly advantageous.

Calibration of switches incorporating an adjusting screw for positioning the second electrical contact may be performed in an oven with the switch heated to the desired threshold temperature level. It will be appreciated that the required manual calibration may result in a substantial percentage of the switches being inaccurately calibrated, depending on the skill of the technician performing the calibration operation. Additionally, this calibration technique is relatively expensive due to the labor costs involved. On the other hand, while denting the switch casing to move the second contact into its final desired position may be accomplished more rapidly by a technician, the final calibration achieved is not always as precise as may be desired.

One approach to the solution of the calibration problem of thermal responsive switching devices is described in U.S. Pat. No. 3,230,607, issued Jan. 25, 1966, to Gelzer. The Gelzer patent discloses a switch in which a bimetal blade is connected to one of a pair of electrically conductive posts extending through a nonconductive mounting structure. In operation, bimetal blade cooperates with a stationary contact on the other of the pair of posts to provide an electrical circuit between the posts until a predetermined threshold temperature is reached. The posts are potted into the nonconductive mounting structure by means of a thermal curable resin.

To calibrate the Gelzer switch, uncured resin is deposited in a cavity in the mounting structure and the thermal responsive switch is heated in an oven to a predetermined temperature. The post bearing the stationary contact is shifted by the bimetal element as the element is heated and deflects. After the post is appropriately positioned by the bimetal element, the heat curable resin cures, fixing the pair of posts in position in the nonconductive mounting structure. While providing a self-calibrating switch, the Gelzer calibration technique is applicable only to a switch structure in which the electrically conductive posts are held within the nonconductive mounting structure only by the thermal curable resin, and would be otherwise free to move with respect to the mounting structure. Accordingly, the fit of the posts in the nonconductive mounting structure must not be so tight as to bind the posts during the calibration operation.

It is seen, therefore, that a need exists for an electrical switching device which is simple in construction and which may be calibrated accurately without the need for manual adjustment of switch parts by a technician.

SUMMARY OF THE INVENTION

An electrical thermostatic switch which assumes a first switching state when the switch is above a predetermined temperature and which assumes a second switching state when the switch is below the predetermined temperature includes a switch casing defining a casing cavity and an opening communicating with the casing cavity. An electrically nonconductive mounting means is positioned in the opening. A thermostatic means extends through the electrically nonconductive mounting means and is supported thereby. The thermostatic means includes a first electrical connector extending outwardly from the mounting means, a thermostatic blade means extending into the casing cavity, and a first electrical contact mounted on the thermostatic blade means. The thermostatic blade means deflects in response to temperature changes. An electrical contact means extends through the electrically nonconductive mounting means and is supported thereby. The electrical contact means includes a second electrical connector extending outwardly from the mounting means, a flexible blade portion extending into the casing, and a second electrical contact mounted on the flexible blade portion. A quantity of cured material in the cavity engages the end of the flexible blade portion, whereby the position of the flexible blade portion and the second electrical contact is fixed and the predetermined temperature is thereby determined. The cured material may consist of a heat curable resin, such as a heat curable epoxy resin.

The electrical thermostatic switch may be of the type in which a closed electrical path is provided between the first and second electrical connectors when the switch is in its second switching state and in which no electrical path is provided between the first and second electrical connectors when the switch is in its first switching state. Alternatively, the electrical thermostatic switch may be of the type in which a closed electrical path is provided between the first and second electrical connectors when the switch is in its first switching state and in which no electrical path is provided between the first and second electrical connectors when the switch is in its second switching state.

The thermostatic blade means may comprise a thermostatic blade member mounted in the electrically nonconductive mounting means and extending into the casing, and an electrically conductive spring blade means electrically connected to the first electrical connector and spring biased into contact with the thermostatic blade member. The first electrical contact is mounted on the electrically conductive spring blade means, whereby thermal deflection of the thermostatic blade member results in corresponding movement of the spring blade means. The spring blade means may include a boss which contacts the thermostatic blade member adjacent the end of the thermostatic blade member.

The thermostatic switch may further comprise a layer of cured material covering the mounting means and surrounding the first and second electrical connectors, whereby the opening is closed and the casing cavity is sealed.

The method of calibrating the thermostatic switch comprises the steps of:

(a) providing a switch casing having a casing cavity and an opening communicating with the casing cavity through the upper portion of the casing, (b) placing a quantity of uncured, curable material in the bottom of the casing cavity, (c) securing an electrical thermostatic contact assembly in the opening, the contact assembly including an electrically nonconductive mounting means supporting a thermostatic blade means and also supporting a flexible blade which extends below the thermostatic blade means into the quantity of uncured, curable material, with first and second electrical contacts being mounted on the thermostatic blade means and the flexible blade, respectively, and with the flexible blade being spring biased such that the second electrical contact is urged against the first electrical contact, (d) heating the thermostatic switch to a predetermined calibration temperature such that the thermostatic blade means deflects to a desired position while the second electrical contact is urged against the first electrical contact, and (e) curing the curable material with the thermostatic blade means in the desired position, whereby the flexible blade means is engaged by the curable material and the position of the second electrical contact is fixed.

Accordingly, it is an object of the present invention to provide an electrical thermostatic switch which is simply constructed and which may be calibrated without the need for manual adjustment of the positions of the switch elements; to provide such a switch in which a first electrical contact is mounted on a thermostatic blade means and a second electrical contact is mounted on a flexible blade, with the flexible blade being engaged by a quantity of cured material and its position fixed; and to provide such a switch in which calibration is performed by heating the switch to a predetermined temperature such that the flexible blade is positioned by the thermostatic blade means and is held in this position by a quantity of cured material.

DETAILED DESCRIPTION OF THE PREFERRED EMBODIMENTS

Figure 1:
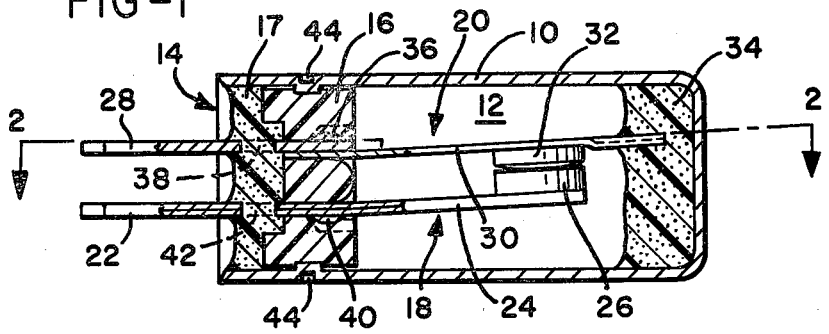
FIG. 1 is a sectional view of the thermostatic switch of the present invention, taken generally along line 1—1 in FIG. 3.
Figure 2:
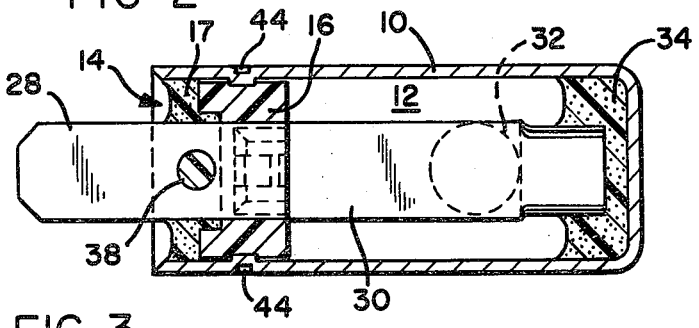
FIG. 2 is a sectional view taken generally along line 2—2 in FIG. 1.
Figure 3:
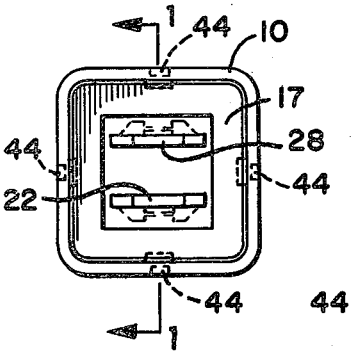
FIG. 3 is an end view of the thermostatic switch as seen looking generally left to right in FIG. 1.

FIGS. 1-3 illustrate an electrical thermostatic switch embodying the present invention. The switch assumes a first switching state when it is above a predetermined temperature and a second switching state when it is below the predetermined temperature. Although the switch described is one which provides a closed electrical circuit when it is below a predetermined temperature, with the circuit being opened only when the temperature of the switch exceeds the predetermined temperature, it will be appreciated, as more fully discussed below, that the present invention will also find application in switches of the type which are normally open and which close only when heated above a predetermined temperature level.

The switch includes a switch casing 10 which defines a casing cavity 12 and an opening, indicated generally at 14, communicating with the casing cavity 12. An electrical thermostatic contact assembly comprises an electrically nonconductive mounting means having an insulating bushing 16 and a layer of cured resin positioned in opening 14. The contact assembly further includes a thermostatic means indicated generally at 18, and electrical contact means indicated generally at 20.

The thermostatic means 18 extends through the electrically nonconductive mounting means 16 and is supported thereby. The thermostatic means 18 includes a first electrical connector 22 extending outwardly from the mounting means 16, as well as a thermostatic blade means 24, which may be a bimetal or multiple metal layer blade, extending into the cavity 12. The thermostatic blade means is configured such that it tends to deflect in response to changes in temperature, with means 24 being mounted such that it moves generally downward, as seen in FIG. 1, as the temperature increases. A first electrical contact 26 is mounted on the thermostatic blade means 24.

Electrical contact means 20 extends through the electrically nonconductive mounting means and is supported thereby. Electrical contact means 20 includes a second electrical connector 28 extending outwardly from the mounting means and a flexible blade portion 30 extending into the casing. A second electrical contact 32 is mounted on the flexible blade portion 30.

Figure 5:
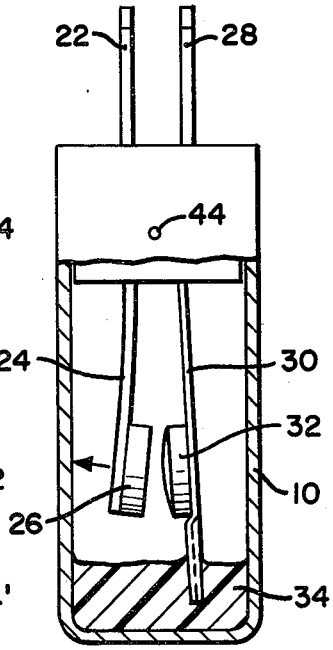
FIG. 5 is a sectional view, similar to FIG. 1, showing the position of the switch elements after the switch is heated to a temperature exceeding a predetermined temperature.

A quantity of cured material 34 in the cavity 12 engages the end of the flexible blade portion 30, whereby the position of flexible blade portion 30 and the second electrical contact 32 is fixed, and the predetermined temperature for switch actuation is thereby determined. Curable material 34 may, for example, be a heat curable epoxy resin. The position of the portion 30 is set such that the first electrical contact 26 just touches the second electrical contact 32 at the predetermined temperature for switch actuation. Therefore, at this predetermined temperature and at all lower temperature levels, contacts 26 and 32 provide a closed electrical path between the connectors 22 and 28, via flexible portion 30 and blade means 24, all of which are electrically conductive. When the temperature of the switch and the thermostatic blade means 24 exceeds this predetermined temperature, however, means 24 is deflected away from portion 30 such that contacts 26 and 32 are separated and the electrical path between connectors 22 and 28 is broken, as shown in FIG. 5.

As seen in FIG. 1, connector 28 and flexible blade portion 30 are formed of separate pieces of conductive material since it is generally desirable to provide a relatively stiff connector. The two pieces of conducting material forming these elements overlap within the bushing 16 and may be welded together. Connector 28 includes a raised boss 36 which is received within the bushing 16 and may, if desired, be engaged by a snap fit arrangement within the bushing. The connector 28 is further engaged by the layer of cured material 17 which extends through a hole 38 in the connector.

Similarly, the connector 22 is engaged by bushing 16 by virtue of boss 40. Connector 22 is also engaged by material 17 which extends through opening 42. Connector 22 is shown as simply an extension of the thermostatic blade means 24. The blade means 24 and connector 22 may, however, be made of separate strips of material and then welded together in a manner similar to portion 30 and connector 28. A thermostatic blade typically has an appreciable electrical resistance which may make its use as an electrical connector undesirable in certain applications.

Figure 4:
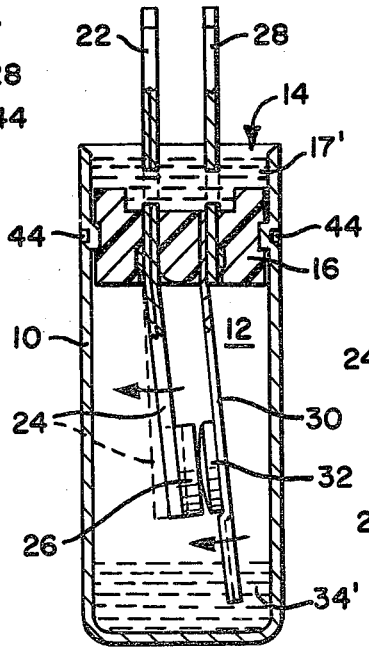
FIG. 4 is a sectional view, similar to FIG. 1, which illustrates the method of calibrating the switch of the present invention.

The thermostatic switch of the present invention has the advantage that it is calibrated without the need for manual adjustment of the relative positions of switch elements by a technician. As shown in FIG. 4, a quantity of liquid uncured, heat curable material 34' is initially placed in the bottom of casing cavity 12. The electrical thermostatic contact assembly is then positioned in opening 14 with the nonconductive mounting bushing 16 being pinned or crimped in position by indentations 44 in the casing 10. Indentations 44 may be made by a sharp tool which is forced against the exterior of the casing 10. A quantity of liquid uncured heat curable material 17' is poured over the electrical thermostatic contact assembly. At this point, the flexible blade portion 30 and the thermostatic blade means 24 are in the solid line positions shown in FIG. 4. The flexible blade means 30 is lightly spring biased such that the second electrical contact 32 is held against the first electrical contact 26. Note that the flexible blade means 30 extends below the thermostatic blade means 24 into the quantity of uncured, heat curable material 34'.

The switch is now placed in an oven which is maintained at the desired predetermined temperature for switch actuation. After a short period of time, the switch temperature is raised to the predetermined temperature level and the thermostatic blade means 24 deflects as indicated to the position shown by the dashed lines. As this occurs, the slight spring force of the thermostatic blade means 30 holds the contact 32 against contact 26. Subsequently, heat curable resin 34' and 17' is cured, fixing the end of the flexible blade portion 30, as shown in FIG. 1, and sealing the opening 14. The switch is now calibrated. It will be appreciated that contacts 26 and 32 will be maintained in direct contact until the switch is heated to a temperature in excess of the predetermined temperature. When this occurs, as shown in FIG. 5, the thermostatic blade means 24 deflects sufficiently such that the contact 26 moves away from contact 32 and the closed electrical path between connectors 22 and 28 is broken.

It should be understood, however, that a switch which is normally open, but which closes when the switch is heated to a temperature in excess of a predetermined temperature level, may also be constructed and calibrated according to the present invention. All that is required for such a switch is that the thermostatic blade means 24 have a reversed temperature deflection characteristic. That is, for such a normally open switch, the thermostatic blade means should be of the type which deflects toward the electrical contact means 30 as the temperature of the switch is increased. During calibration of such a switch in an oven, as with the switch described above with respect to FIGS. 1–5, the light spring force of the flexible blade portion 30 maintains the electrical contacts together as the thermostatic blade means deflects and the heat curable resin is cured. Thereafter, when the switch is removed from the oven, the thermostatic blade means will deflect away from the electrical contact means and a closed electrical path will not be re-established between the pair of electrical connectors until the switch is heated once again to the predetermined temperature.

Figure 6:
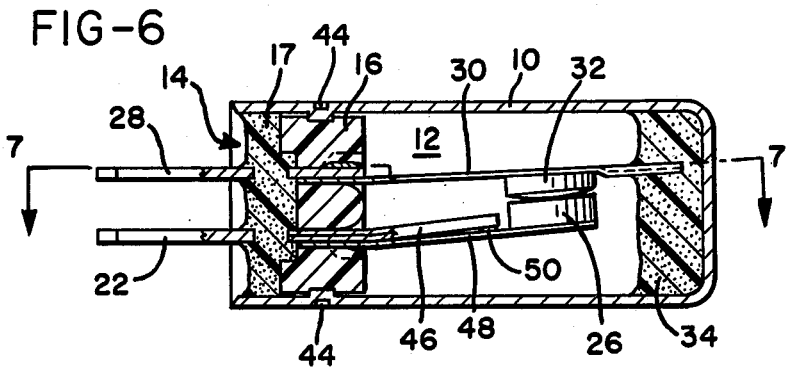
FIG. 6 is a sectional view, similar to FIG. 1, of an alternative embodiment of the switch of the present invention.
Figure 7:
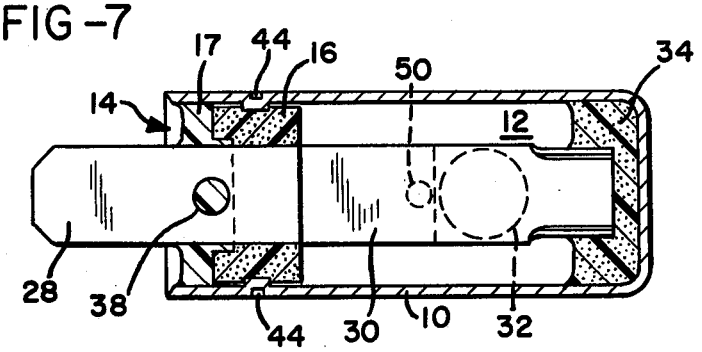
FIG. 7 is a sectional view of the switch of FIG. 6, taken generally along line 7—7 in FIG. 6.

FIGS. 6 and 7 illustrate an alternative embodiment of the switch of the present invention, with the switch elements corresponding to those of the switch shown in FIGS. 1–5 being indicated with the same reference numerals. The switch of FIGS. 6 and 7 differs from that of FIGS. 1–5 in that the thermostatic means includes a thermostatic blade member 46, and a separate electrically conductive spring blade means 48 upon which the first electrical contact 26 is mounted. The spring blade means 48 is lightly spring biased toward the thermostatic blade member 46 such that boss 50 contacts the thermostatic blade member 46 adjacent the end of member 46. Thus, the spring blade means 48 is held in contact with the thermostatic blade member 46 and moves with the member 46 as the member deflects during heating and cooling of the switch.

The spring blade means 48 electrically contacts the thermostatic blade member 46 within the bushing 16 such that the blade member 46 is effectively shorted out of the electrical circuit between the connector 22 and the connector 28. The spring blade means 48 is made of a high conductivity metal and, as a result, there is little resistive heating as current flows through the switch. It will be appreciated that an $I^2R$ heating effect may raise the temperature of the switch slightly with respect to the ambient temperature, such that the temperature at which the switch changes electrical switching states may be affected. By removing the thermostatic blade member from the electrical circuit, this problem is eliminated. In some applications, however, the $I^2R$ heating effects will be negligible and the switch of FIGS. 1–5 will be preferred due to its simplicity of construction.

It is generally desirable, in either embodiment, to utilize a material for the flexible blade portion 30 which has a very low spring constant. If too great a spring constant is provided, the resulting spring force may affect the position of the thermostatic element and the flexible blade portion during the calibration process.

It will be appreciated that it is necessary to utilize a heat curable resin material which cures at a temperature equal to or less than the predetermined temperature level chosen for actuation of the switch. It is possible, however, to utilize a curable material which is cured by a mechanism other than heat. A curable material may be selected, for instance, which cures after being mixed with a catalyst. With such a material, it was only necessary to place the switch in an oven at the desired predetermined temperature such that the thermostatic element deflects to the desired position prior to and during curing to the curable material.

While the apparatus herein described and the method of making the apparatus consitute preferred embodiments of the invention, it is to be understood that the invention is not limited to this precise method and forms of apparatus, and that changes may be made in either without departing from the scope of the invention.

What is claimed is:

1. An electrical thermostatic switch which assumes a first switching state when said switch is above a predetermined temperature, and which assumes a second switching state when said switch is below said predetermined temperature, comprising:

a switch casing defining a casing cavity and an opening communicating with said casing cavity, electrically nonconductive mounting means positioned in said opening, thermostatic means extending through said electrically nonconductive mounting means and supported thereby, said thermostatic means including a first electrical connector extending outwardly from said mounting means, a thermostatic blade means, extending into said casing cavity, said thermostatic blade means deflecting in response to temperature changes, and a first electrical contact mounted on said thermostatic blade means, electrical contact means extending through said electrically nonconductive mounting means and supported thereby, said electrical contact means including a second electrical connector extending outwardly from said mounting means, a flexible blade portion extending into said casing, and a second electrical contact mounted on said flexible blade portion, and a quantity of cured material in said cavity engaging the end of said flexible blade portion, whereby the position of said flexible blade portion and said second electrical contact is fixed and said predetermined temperature is thereby determined.

2. The electrical thermostatic switch of claim 1 in which a closed electrical path is provided between said first and second electrical connectors when said switch is in said second switching state and in which no electrical path is provided between said first and second electrical connectors when said switch is in said first switching state.

3. The electrical thermostatic switch of claim 1 in which a closed electrical path is provided between said first and second electrical connectors when said switch is in said first switching state and in which no electrical path is provided between said first and second electrical connectors when said switch is in said second switching state.

4. The electrical thermostatic switch of claim 1 in which said quantity of cured material consists of a heat curable resin.

5. The electrical thermostatic switch of claim 4 in which said resin is a heat curable epoxy resin.

6. The electrical thermostatic switch of claim 1 in which said thermostatic blade means comprises a thermostatic blade member mounted in said electrically nonconductive mounting means and extending into said casing cavity, and an electrically conductive spring blade means, electrically connected to said first electrical connector and spring biased into contact with said thermostatic blade member, said first electrical contact being mounted on said electrically conductive spring blade means, whereby thermal deflection of said thermostatic blade member results in corresponding movement of said spring blade means.

7. The electrical thermostatic switch of claim 6 in which said spring blade means includes a boss contacting said thermostatic blade member adjacent the end of said thermostatic blade member.

8. The electrical thermostatic switch of claim 1 in which said mounting means further comprises a layer of cured material surrounding said first and second electrical connectors, closing said opening and sealing said casing cavity.

9. The method of calibrating a thermostatic switch, comprising the steps of:

providing a switch casing having a casing cavity and an opening communicating with said casing cavity through the upper portion of said casing, placing a quantity of uncured, heat curable material in the bottom of said casing cavity, securing an electrical thermostatic contact assembly in said opening, said contact assembly including an electrically nonconductive mounting means supporting a thermostatic blade means and a flexible blade extending below said thermostatic blade means into said quantity of uncured, heat curable material, first and second electrical contacts being mounted on said thermostatic blade means and said flexible blade, respectively, said flexible blade being spring biased such that said second electrical contact is urged against said first electrical contact, and heating said thermostatic switch to a predetermined calibration temperature, which temperature exceeds that required for curing said uncured, heat curable material such that said thermostatic blade means deflects to a desired position while said second electrical contact is urged against said first electrical contact and, thereafter, said heat curable material is cured, whereby said flexible blade is engaged by said heat curable material and the position of said second electrical contact is fixed.

10. The method of claim 9, in which the step of securing an electrical thermostatic contact assembly in said opening comprises the step of distorting said casing around said assembly, whereby said assembly is securely engaged by said casing.

11. The method of claim 9 further comprising the steps of covering said electrical thermostatic contact assembly with a second quantity of uncured, heat curable material prior to heating said thermostatic switch such that said second quantity of uncured, heat curable material is cured as said switch is heated and said casing cavity thereby sealed.

12. The method of calibrating a thermostatic switch, comprising the steps of:

providing a switch casing having a casing cavity and an opening communicating with said casing cavity through the upper portion of said casing, placing a quantity of uncured, curable material in the bottom of said casing cavity, securing an electrical thermostatic contact assembly in said opening, said contact assembly including an electrically nonconductive mounting means supporting a thermostatic blade means and a flexible blade extending below said thermostatic blade means into said quantity of uncured, curable material, first and second electrical contacts being mounted on said thermostatic blade means and said flexible blade, respectively, said flexible blade being spring biased such that said second electrical contact is urged against said first electrical contact, heating said thermostatic switch to a predetermined calibration temperature, such that said thermostatic blade means deflects to a desired position while said second electrical contact is urged against said first electrical contact, and curing said curable material with said thermostatic blade means in said desired position, whereby said flexible blade is engaged by said curable material and the position of said second electrical contact is fixed.

13. The method of claim 12, in which the step of securing an electrical thermostatic contact assembly in said opening comprises the step of distorting said casing around said assembly, whereby said assembly is securely engaged by said casing.

14. The method of claim 12 further comprising the step of sealing said opening communicating with said casing cavity.

* * * * *